US008696305B2

(12) United States Patent
Farlow et al.

(10) Patent No.: US 8,696,305 B2
(45) Date of Patent: Apr. 15, 2014

(54) AXIAL FAN ASSEMBLY

(75) Inventors: Scott K. Farlow, Cedar Falls, IA (US); Christopher A. Bering, Dike, IA (US); Andrew K. Rekow, Cedar Falls, IA (US)

(73) Assignee: Deere & Company, Moline, IL (US)

( * ) Notice: Subject to any disclaimer, the term of this patent is extended or adjusted under 35 U.S.C. 154(b) by 393 days.

(21) Appl. No.: 13/150,709

(22) Filed: Jun. 1, 2011

(65) Prior Publication Data

US 2012/0308373 A1 Dec. 6, 2012

(51) Int. Cl.
*F04D 19/02* (2006.01)
*F04D 29/54* (2006.01)
*F04D 29/70* (2006.01)

(52) U.S. Cl.
USPC ..... 415/121.2; 415/192; 415/193; 415/209.1; 415/210.1; 416/247 R

(58) Field of Classification Search
USPC ..... 415/121.2, 191, 192, 193, 208.2, 209.1, 415/209.4, 210.1, 211.2; 416/247 R
See application file for complete search history.

(56) References Cited

U.S. PATENT DOCUMENTS

| | | | | |
|---|---|---|---|---|
| 6,142,733 | A | 11/2000 | Alizadeh et al. | |
| 6,905,307 | B2 | 6/2005 | Kawarada et al. | |
| 2003/0138321 | A1 * | 7/2003 | Somahara et al. | 415/121.2 |
| 2007/0122271 | A1 * | 5/2007 | Ishihara et al. | 415/191 |
| 2008/0118379 | A1 * | 5/2008 | Uchise et al. | 417/423.1 |
| 2008/0193287 | A1 * | 8/2008 | Kobayashi et al. | 415/208.2 |

OTHER PUBLICATIONS

R.K. Turton. "Principles of Turbomachinery". (Chapman & Hall, 1995). pp. 6-9.

* cited by examiner

*Primary Examiner* — Christopher Verdier

(57) ABSTRACT

A fan assembly includes an axial flow fan between an inlet stator and an outlet stator. The inlet stator has inlet stator blades which extend outwardly from an inner ring. Each inlet stator blade has a downstream edge which has a tangent which is oriented at a first variable angle with respect to a plane which is perpendicular to the fan axis. The first angle increases with increasing distance from the inner support ring. The outlet stator has a plurality of outlet stator blades which extend outwardly from a second inner ring. Each outlet stator blade has an upstream edge which has a tangent which is oriented at a second variable angle with respect to a plane which is perpendicular to the fan axis. The second angle decreases with increasing distance from the inner ring.

8 Claims, 7 Drawing Sheets

AXIAL FAN ASSEMBLY

FIELD OF THE INVENTION

The present disclosure relates to an axial fan assembly, such as for a vehicle cooling system.

BACKGROUND OF THE INVENTION

Axial fans are used in vehicle cooling systems. Such fans can create a region of low air flow velocity both ahead of and behind the fan drive hub. When such a fan is closely coupled to a series of heat exchangers, this can result in poor utilization of the heat exchange surface near the area of low velocity. It is believed that system efficiency can be improved by pre-conditioning the air that enters the fan and post-conditioning the air that leaves the fan.

SUMMARY

According to an aspect of the present disclosure, a fan assembly includes an axial flow fan which is positioned between an inlet stator and an outlet stator. The inlet stator has inlet stator blades which extend outwardly from a first inner ring. Each inlet stator blade has a downstream edge which has a tangent which is oriented at a first variable angle with respect to a plane which is perpendicular to an axis of the fan. The first angle increases with increasing distance from the first inner ring. The outlet stator has a plurality of outlet stator blades which extend outwardly from a second inner ring. Each outlet stator blade has an upstream edge which has a tangent which is oriented at a second variable angle with respect to a plane which is generally perpendicular to the fan axis. The second angle decreases with increasing distance from the second inner ring.

DESCRIPTION OF THE PREFERRED EMBODIMENT

Figure 1:
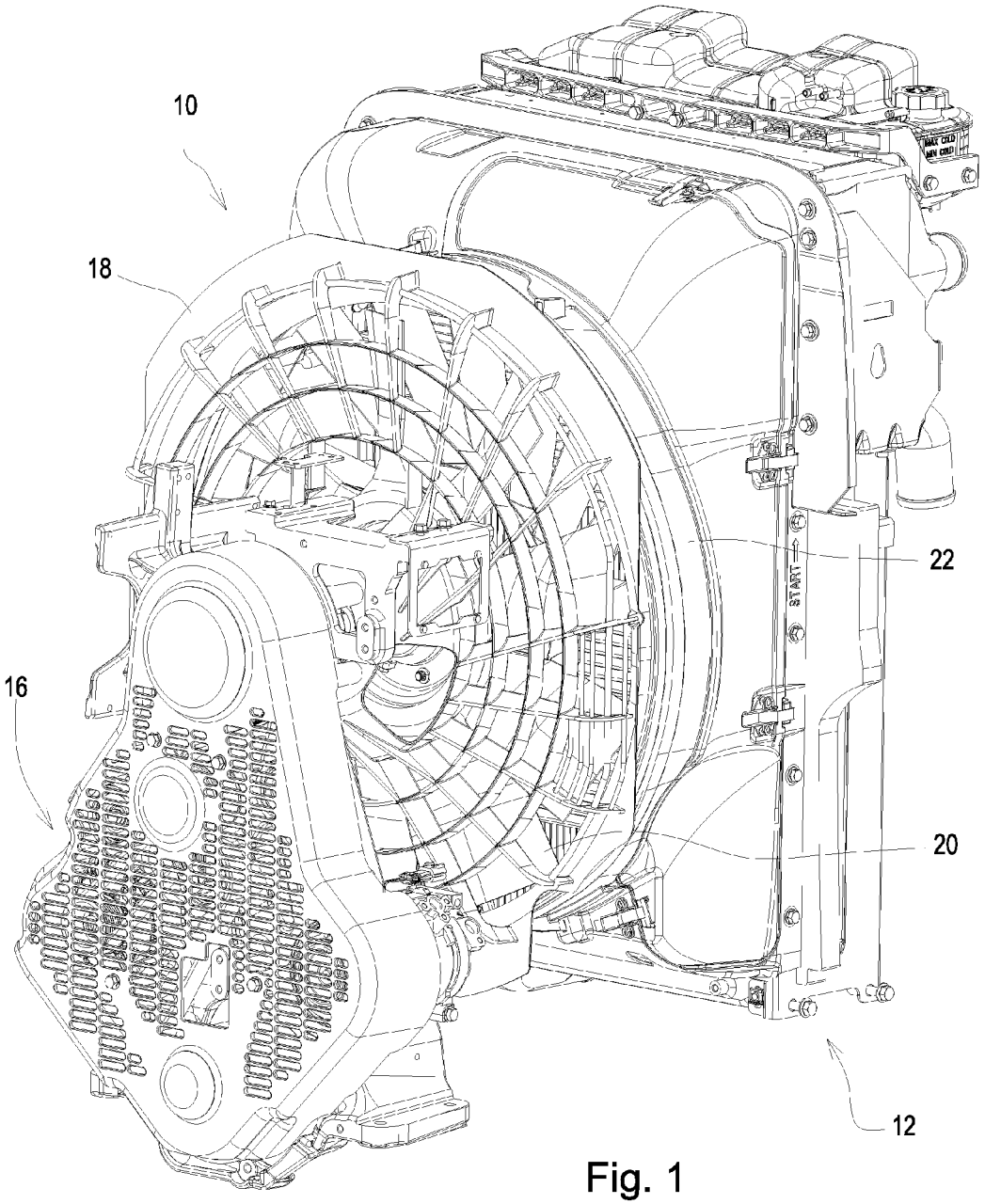
FIG. 1 is a perspective view of a fan assembly embodying the invention.

Referring to FIG. 1, a fan assembly 10 directs air to heat exchanger assembly or radiator 12 for a vehicle (not shown). The fan assembly 10 includes a fan drive 16, an inlet stator 18, and axial flow fan 20 and an outlet stator 22. The fan 20 is mounted in front of or upstream of the radiator 12.

Figure 2:
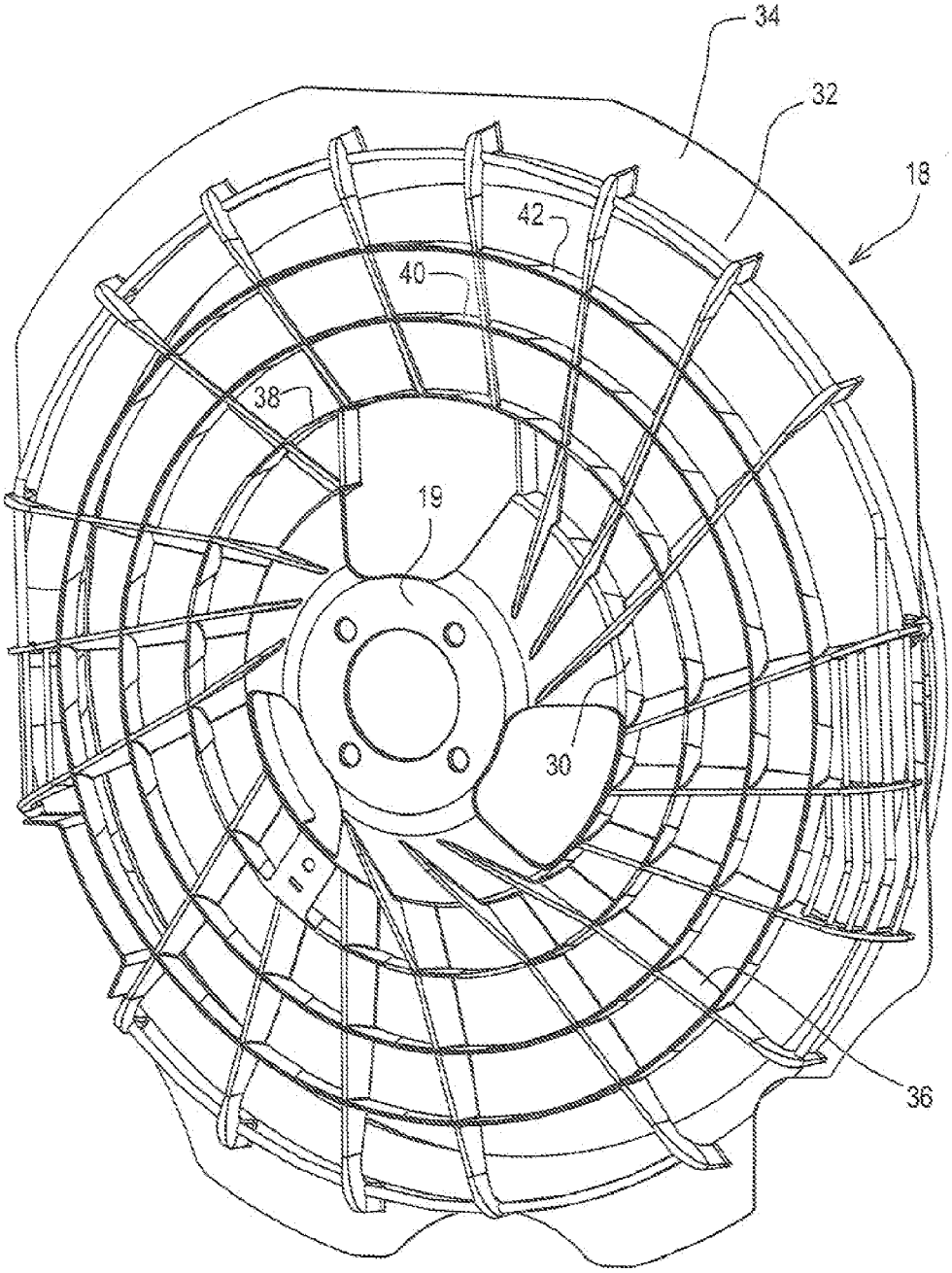
FIG. 2 is a perspective view of a the inlet stator of FIG. 1.
Figure 3:
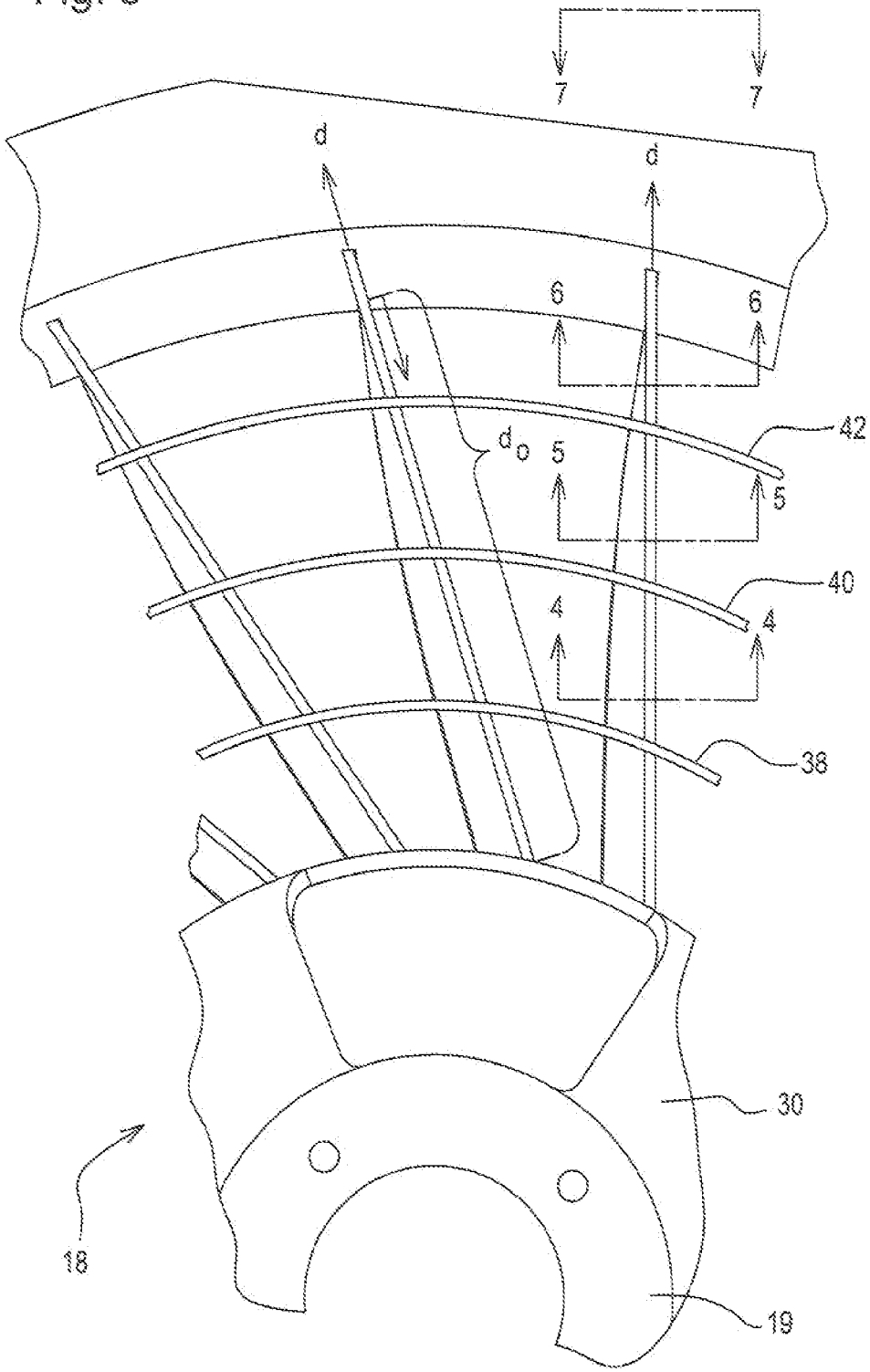
FIG. 3 is a front view of a portion of the inlet stator of FIG. 2.

Referring now to FIGS. 2 and 3, the inlet stator 18 includes a central hub 19 which includes an inner support ring 30, and an outer housing 34 which includes an outer support ring 32. The inlet stator 18 also includes a plurality of inlet stator blades or vanes 36. The blades 36 extend between the rings 30 and 32. A plurality of annular cylindrical stiffening rings 38, 40 and 42 are joined to the blades 36 and are spaced apart between the rings 30 and 32. The downstream edges of the rings 30 and 38-42 lie in or adjacent to a downstream plane 44 which is perpendicular to the rotation axis of the fan 20. Each inlet stator blade 36 has an upstream edge 46 and a downstream edge 48.

Because the fan 20 is mounted in front of the radiator 12, the fan 20 is more accessible, and the inlet stator 18 functions as a finger guard. Thus, the inlet stator 18 functions both a finger guard and to "pre-swirl" the air so that the airflow better matches the geometry of the fan 20.

Figure 4:
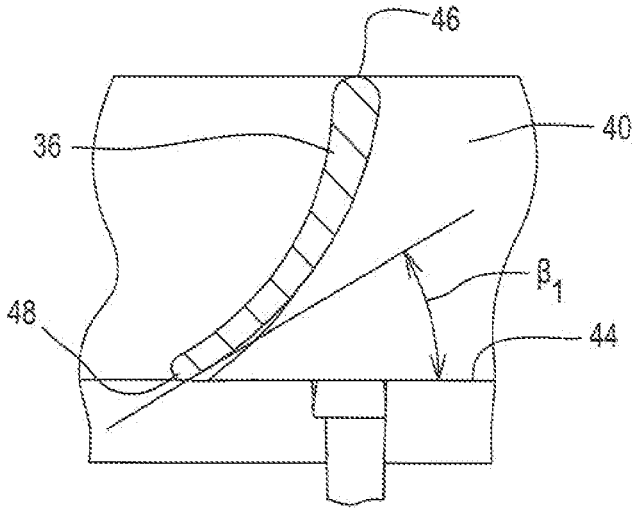
FIG. 4 is a view taken along lines 4-4 of FIG. 3.
Figure 5:
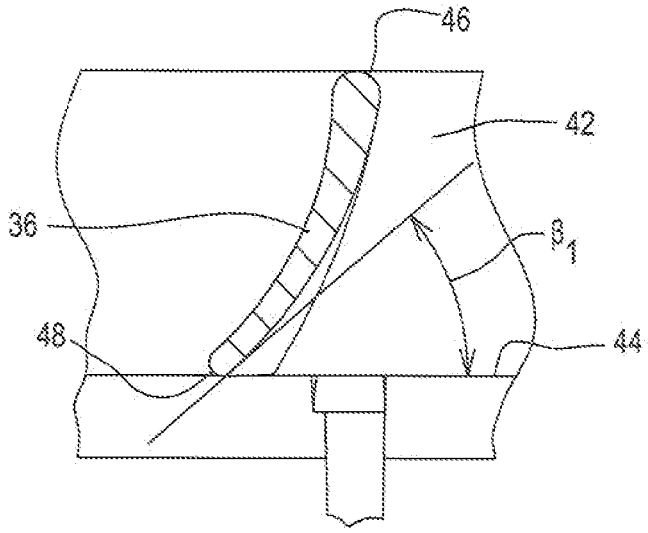
FIG. 5 is a view taken along lines 5-5 of FIG. 3.
Figure 6:
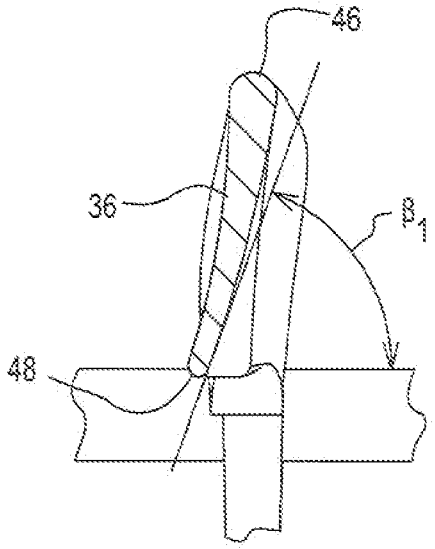
FIG. 6 is a view taken along lines 6-6 of FIG. 3.
Figure 7:
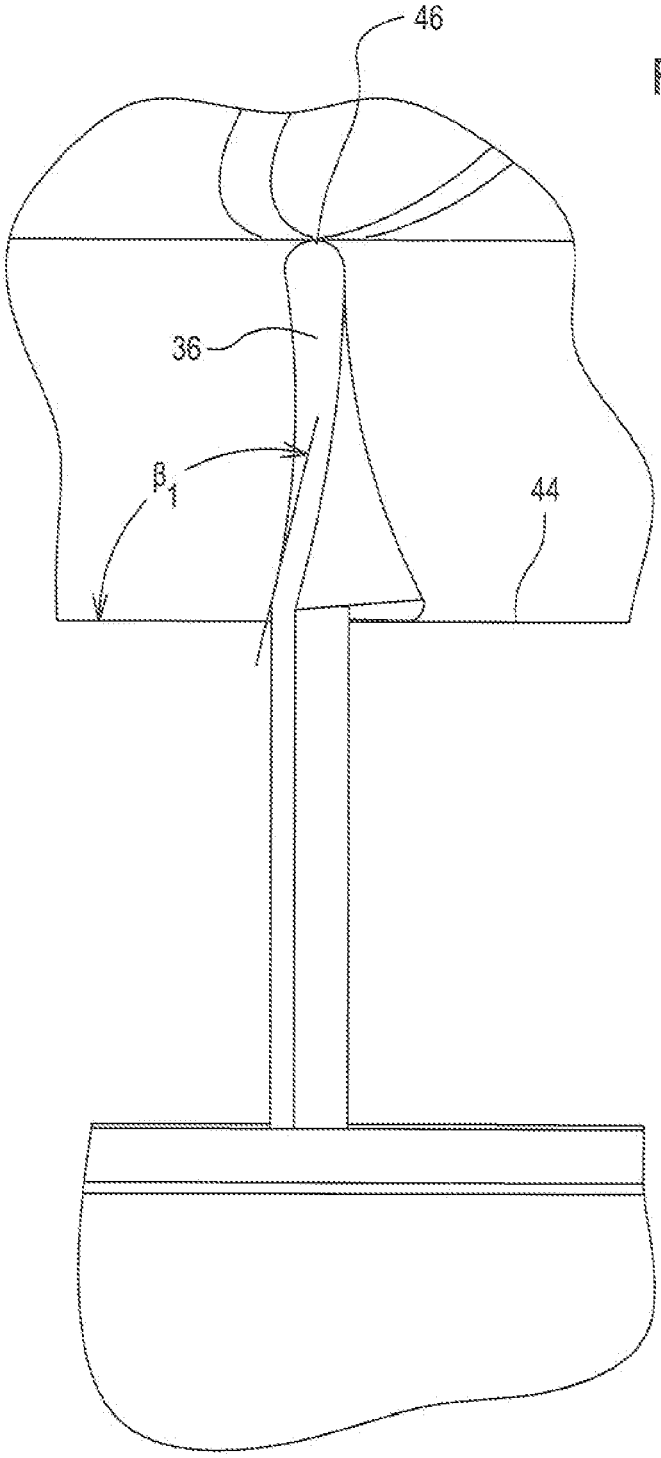
FIG. 7 is a view taken along lines 7-7 of FIG. 3.

Referring now to FIGS. 4, 5, 6 and 7, the downstream edge 48 of each inlet stator blade 36 defines a tangent which is oriented at a first variable angle B1 with respect to the downstream plane 44, and this first angle B1 increases with increasing distance d1 from the inner support ring and varies continuously along a length of each inlet stator blade 36. For example, as shown in FIG. 4, between ring 30 and ring 38, this first variable angle is preferably 19.84 degrees with a tolerance of +/−0.5 degrees. As shown in FIG. 5, between ring 38 and ring 40, this a first variable angle is preferably 35.347 degrees with a tolerance of +/−0.5 degrees. As shown in FIG. 6, between ring 40 and ring 32, this a first variable angle is preferably 43.624 degrees with a tolerance of +/−0.5 degrees. Moving outwardly from ring 38 to distance d0 from ring 38, the first angle B1 increases from a minimum angle to 90 degrees (or generally perpendicular) at distance d0. Beyond distance d0 the first angle $B_1$ increases to angles greater than 90 degrees, as best seen in FIG. 7.

Preferably, the angle $B_l$ varies as a function of $U_r$ and the distance d1 according to the following equations, where Ur is the fan blade velocity, which changes as one moves from blade root to tip, Q is the volumetric air flow rate of the fan 20, $A_1$ is the annular flow area of the inlet stator 18 between rings 30 and 32, and $\delta_1$ is the fan leading edge attack angle to vertical (specific to fan 20).

For $U_r<(W_1*\cos(\delta_1))$(distance $d1$ between 0 and $d0$), $$B_1=90+\cos^{-1}(V_1\div(W_1^2+U_r^2-2*W_1*U_r*\cos(\delta_1))^{1/2}),$$

and

For $U_r>(W_1*\cos(\delta_1))$(distance $d1$ greater than $d0$), $$B_1=90-\cos^{-1}(V_1\div(W_1^2+U_r^2-2*W_1*U_r*\cos(\delta_1))^{1/2}),$$

where $V_1$ (inlet stator air velocity)=$Q\div A_1$, and $W_1$ (fan inlet vector)=$V_1\div\sin(\delta_1)$, and $U_r$=(fan speed*$P_i$*2*d1)÷60.

It should be noted, that, due to manufacturing constraints, it would be permissible or desirable to not allow the stator blade angle to exceed 90 degrees.

Figure 8:
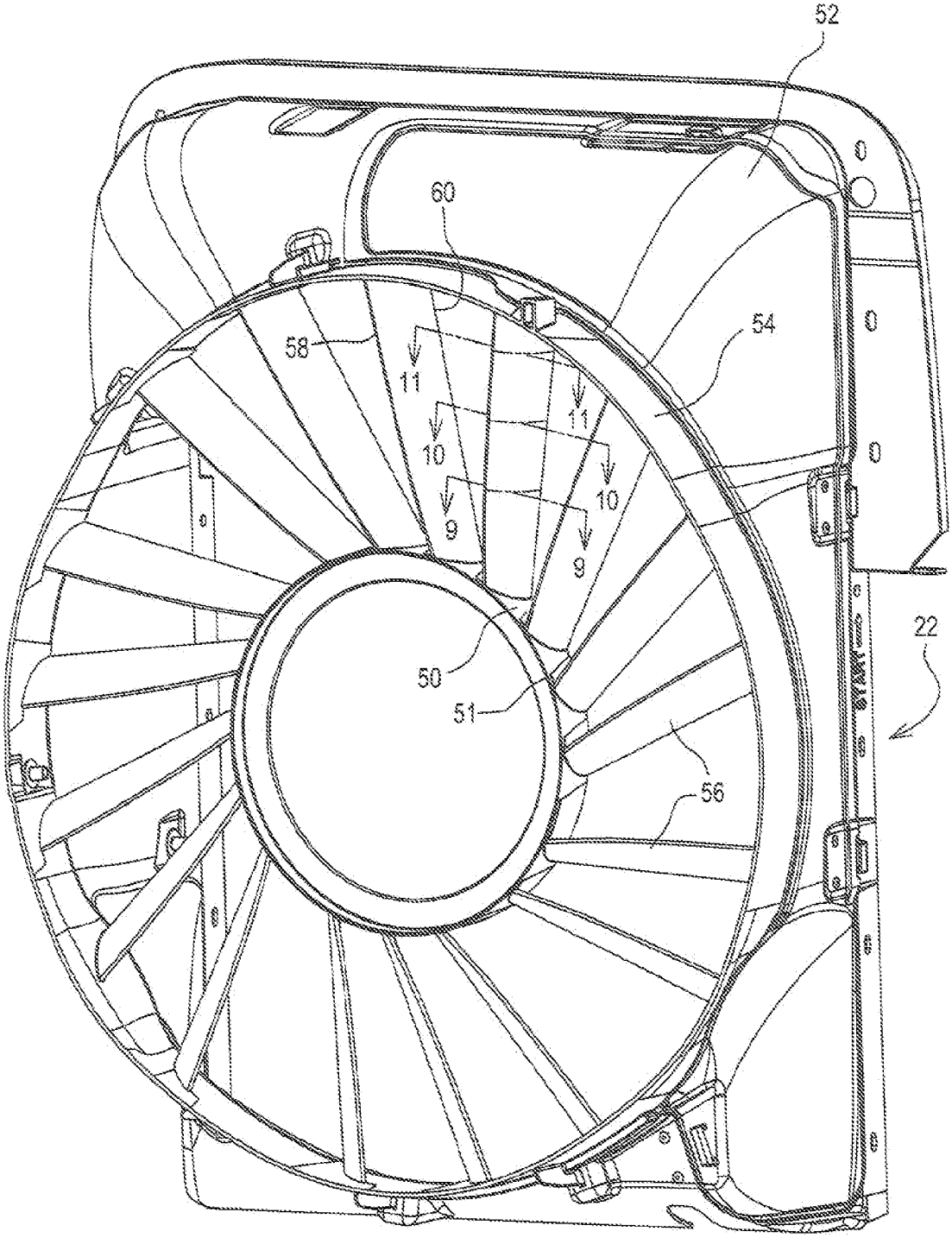
FIG. 8 is a perspective view of the outlet stator of FIG. 1.

Referring now to FIG. 8, the outlet stator 22 includes an inner ring 50 and an outer housing 52 which includes an outer ring 54. Outlet stator 22 includes a plurality of outlet stator blades or vanes 56. Each blade 56 extends between the rings 50 and 54. An upstream edge 51 of the inner ring 50 defines an outlet stator plane 53 which is perpendicular to the rotation axis of the fan 20. Each outlet stator blade 56 has an upstream edge 58 and a downstream edge 60. The downstream edges of the rings 50 and 54 lie in or adjacent to a downstream plane 55 which is perpendicular to the rotation axis of the fan 20. Preferably, the inlet stator 18 and outlet stator 22 preferably have a different prime numbers (19 and 17, respectively) of conditioning blades 26 and 56, respectively. This helps to minimize the noise levels produced by the fan assembly 10. The outlet stator 22 receives the complex, swirling air flow coming off of the fan 20 and turns it to flow substantially in the axial direction to more efficiently pass through the radiator 12.

Figure 9:
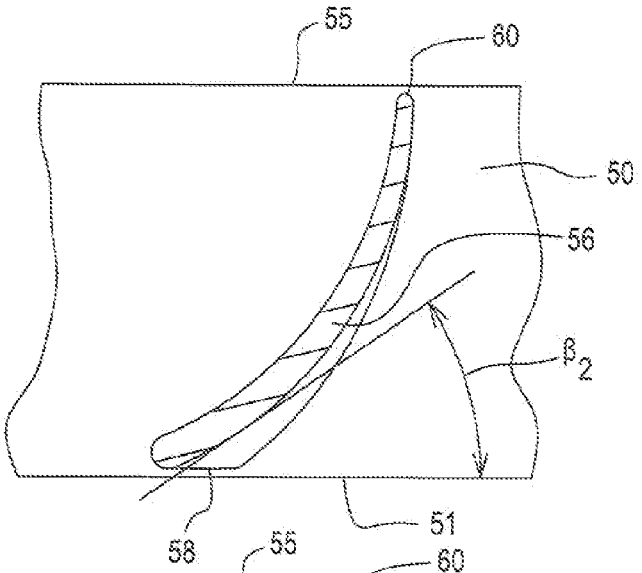
FIG. 9 is a view taken along lines 9-9 of FIG. 8.
Figure 10:
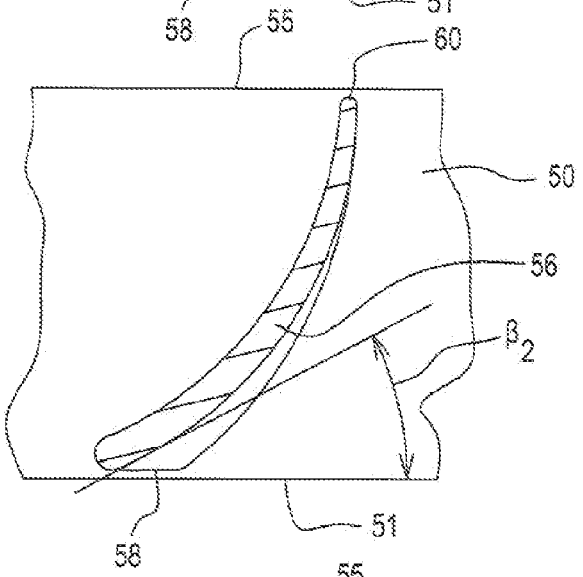
FIG. 10 is a view taken along lines 10-10 of FIG. 8.
Figure 11:
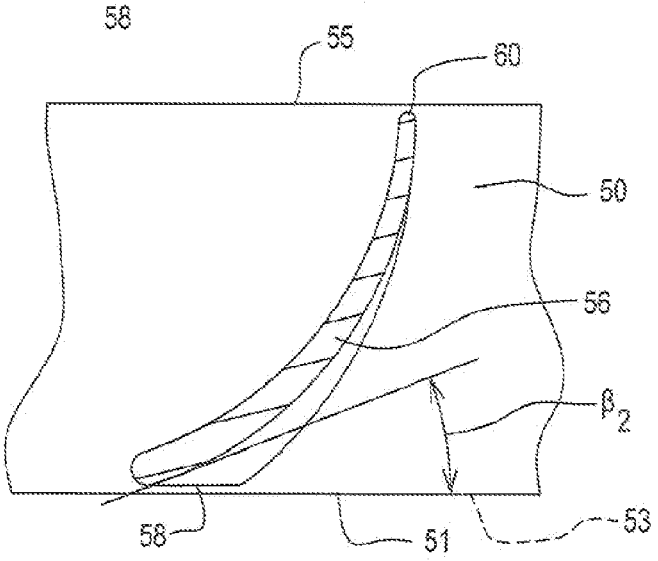
FIG. 11 is a view taken along lines 11-11 of FIG. 8.

Referring now to FIGS. 9, 10 and 11, the upstream edge 58 of each outlet stator blade 56 defines a tangent which is oriented at a second variable angle B2 with respect to the outlet stator plane 53, and this second angle B2 decreases with increasing distance d2 from the inner ring 50, and varies continuously along the length of each outlet stator blade 56. For example, as shown in FIG. 8, at approximately one fourth of the radial distance from ring 50 to ring 54, this second variable angle is preferably 27.3 degrees with a tolerance of +/−0.5 degrees. As shown in FIG. 9, at approximately one half of the radial distance from ring 50 to ring 54, this second variable angle is preferably 15.3 degrees with a tolerance of +/−0.5 degrees. As shown in FIG. 10, at approximately three fourths of the radial distance from ring 50 to ring 54, this second variable angle is preferably 14.6 degrees with a tolerance of +/−0.5 degrees.

Preferably, the angle $B_2$ varies as a function of the distance d2 according to the following equation, where Q is the volumetric air flow rate of the fan 20, $A_2$ is the annular flow area of the outlet stator 22 between rings 50 and 54, and $a_2$ is 90 minus the fan trailing edge attack angle to vertical (specific to fan 20).

$$B_2=90-\cos^{-1}(V_2\div(W_2^2+U_r^2-2*W_2*U_r*\cos(\delta_2))^{1/2})$$

where $V_2$(outlet stator air velocity)=Q÷$A_2$, $W_2$(fan outlet vector)=$V_2$÷cos $a_2$, and $\delta_2$=sih$^{-1}$($V_2$*$W_2$), and $U_r$=(fan speed*$P_i$*2*d2)÷60.

The inlet stator 18 both conditions the air entering the fan 20 and provides a functional guard to the fan 20. The inlet stator 18 pre-conditions the air flowing into the fan 20 to improve the pumping efficiency and flow rate of the simple and easily manufactured fan 20. The outlet stator 22 creates a uniform airflow distribution on the face of the heat exchanger assembly 12 and aligns the flow direction of the air with the flow passages (not shown) in the heat exchanger assembly 12. This more uniform airflow increases the cooling efficiency and capacity of the heat exchanger assembly 12.

The inlet 18 and outlet 22 stators are designed with an air foil shape that changes angle with fan blade length (variable twist) to be at the same angle as the air desires to enter and exits the blades of the fan 20. The inlet stator 18 conditions the air entering the fan 20 and the outlet stator 22 directs the air towards the passages of the radiator 12 of a cooling system. This system of stators and fan improves the amount of useful work done in the system.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

We claim:

1. A fan assembly comprising:

an axial flow fan which rotates about a central fan axis;

an inlet stator positioned upstream of the fan, the inlet stator having a first inner support ring, and a plurality of inlet stator blades extending outwardly from the first inner support ring, each inlet stator blade having an upstream edge and a downstream edge, said downstream edge terminating adjacent to a first end plane which is generally perpendicular to the central fan axis, said downstream edge having a tangent which is oriented at a first variable angle, B1, with respect to said first end plane, and said first variable angle increasing with increasing distance, d1, from the inner support ring and said first variable angle varying continuously along a length of each inlet stator blade; and an outlet stator positioned downstream of the fan, the outlet stator having a second inner support ring, and a plurality of outlet stator blades extending outwardly from the second inner support ring, each outlet stator blade having an upstream edge and a downstream edge, said upstream edge of each outlet stator blade terminating adjacent to a second end plane which is generally perpendicular to the central fan axis, said upstream edge having a tangent which is oriented at a second variable angle, B2, with respect to said second end plane, and said second variable angle decreasing with increasing distance d2 from the inner support ring and said second variable angle varying continuously along a length of each outlet stator blade.

2. The fan assembly of claim 1, wherein:

the inlet stator functions as a finger guard with respect to the fan.

3. The fan assembly of claim 1, wherein:

the inlet stator functions to pre-swirl air so that airflow matches fan geometry.

4. The fan assembly of claim 1, wherein:

the inlet stator functions as a finger guard with respect to the fan, and the inlet stator functions to pre-swirl air so that airflow matches fan geometry and improves efficiency of the fan.

5. The fan assembly of claim 1, wherein:

the outlet stator catches complex, swirling air flow coming off of the fan and causes the air to flow substantially in an axial direction.

6. The fan assembly of claim 1, wherein:

the angle B1 varies as a function of the distance d1 according to the following equations, where Q is a volumetric air flow rate of the fan, A1 is an annular flow area of the inlet stator, and 1 is a fan leading edge attack angle to vertical:

for $Ur<(W1*\cos(1))$, $B1=90+\cos-1(V1\div(W12+Ur2-2*W1*Ur*\cos(1))½)$, and for $Ur>(W1*\cos(1))$, $B1=90-\cos-1(V1\div(W12+Ur2-2*W1*Ur*\cos(1))½)$, where V1=Q÷A1, and W1=V1÷sin(1), and Ur=(fan speed*Pi*2*d1)÷60.

7. The fan assembly of claim 1, wherein:

the angle B2 varies as a function of the distance d2 according to the following equation, where Q is a volumetric air flow rate of the fan, A2 is an annular flow area of the outlet stator, and a2 is 90 minus a fan trailing edge attack angle to vertical:

$$B2=90-\cos-1(V2\div(W22+Ur2-2*W2*Ur*\cos(2))½)$$

where V2=Q÷A2, W2=V2÷cos a2, and 2=sih−1(V2÷W2), and Ur=(fan speed*Pi*2*d2)÷60.

8. The fan assembly of claim 1, wherein:

the angle B1 varies as a function of the distance d1 according to the following equations, where Q is a volumetric air flow rate of the fan, A1 is an annular flow area of the inlet stator, and 1 is a fan leading edge attack angle to vertical:

for distance $d1$ between 0 and $d0$, $B1=90+\cos-1(V1\div(W12+Ur2-2*W1*Ur*\cos(1))½)$, and for distance $d1$ greater than $d0$, $B1=90-\cos-1(V1\div(W12+Ur2-2*W1*Ur*\cos(1))½)$, where V1=Q÷A1, and W1=V1÷sin(1), and Ur=(fan speed*Pi*2*d1)÷60; and the angle B2 varies as a function of the distance d2 according to the following equation, where Q is a volumetric air flow rate of the fan, A2 is an annular flow area of the outlet stator, and a2 is 90 minus a fan trailing edge attack angle to vertical:

$$B2=90-\cos-1(V2\div(W22+Ur2-2*W2*Ur*\cos(2))^{1/2})$$

where V2=Q÷A2, W2=V2÷cos a2, and 2=sih−1 (V2÷W2), and Ur=(fan speed*Pi*2*d2)÷60.

* * * * *